United States Patent [19]

Hosokawa et al.

[11] Patent Number: 4,471,194

[45] Date of Patent: Sep. 11, 1984

[54] ELECTROMAGNETIC ENERGY SEAL FOR HIGH FREQUENCY HEATING APPARATUS

[75] Inventors: Tomoyuki Hosokawa, Nara; Shigeru Kusunoki, Kyoto; Teruhisa Takano, Osaka; Hirofumi Yoshimura, Nara, all of Japan

[73] Assignee: Matsushita Electric Industrial Co., Ltd., Osaka, Japan

[21] Appl. No.: 490,861

[22] Filed: Jul. 22, 1974

Related U.S. Application Data

[63] Continuation of Ser. No. 253,259, May 15, 1972, abandoned.

[30] Foreign Application Priority Data

| | | | |
|---|---|---|---|
| May 20, 1971 | [JP] | Japan | 46-35046 |
| Jun. 9, 1971 | [JP] | Japan | 46-41216 |
| Jun. 18, 1971 | [JP] | Japan | 46-44293 |
| Jun. 18, 1971 | [JP] | Japan | 46-44294 |
| Jun. 18, 1971 | [JP] | Japan | 44-44322 |
| Aug. 6, 1971 | [JP] | Japan | 46-59702 |
| Nov. 9, 1971 | [JP] | Japan | 46-89632 |
| Nov. 16, 1971 | [JP] | Japan | 46-92260 |

[51] Int. Cl.[3] ..... H05B 6/76

[52] U.S. Cl. ..... 219/10.55 D; 219/10.55 F

[58] Field of Search ..... 219/10.55 D, 10.55 F, 219/10.55 A, 10.55 R; 174/35 GC, 35 MS, 35 R, 35 CE; 333/248, 228, 230, 81 R, 81 B

[56] References Cited

U.S. PATENT DOCUMENTS

| | | | |
|---|---|---|---|
| 2,417,785 | 3/1947 | Slepian | 174/35 CE |
| 2,500,676 | 3/1950 | Hall et al. | |
| 2,718,542 | 9/1955 | Lapsley | 174/35 CE |
| 2,772,402 | 11/1956 | Tomiyasu | |
| 2,783,295 | 2/1957 | Ewing | 174/35 GC |
| 2,820,201 | 1/1958 | Tomiyasu | |
| 2,829,347 | 4/1958 | Tomiyasu | |
| 2,850,706 | 9/1958 | Gabriel | |
| 2,857,415 | 2/1959 | Sferrazza | |
| 2,907,961 | 10/1959 | Tomiyasu | |
| 2,956,143 | 10/1960 | Schall | |
| 3,050,606 | 8/1962 | Tibbs | |
| 3,155,923 | 11/1964 | Persson | |
| 3,182,164 | 5/1965 | Ironfield | |
| 3,351,730 | 11/1967 | Pahlman | |
| 3,448,232 | 6/1969 | Kluck | |
| 3,504,095 | 3/1970 | Roberson et al. | 174/35 GC |
| 3,525,841 | 8/1970 | Haagensen et al. | 219/10.55 D |
| 3,584,177 | 6/1971 | Bucksbaum | 219/10.55 D |
| 3,629,537 | 12/1971 | Haagensen | 219/10.55 D |
| 3,767,884 | 10/1973 | Osepchuk et al. | 219/10.55 D |

FOREIGN PATENT DOCUMENTS

| | | |
|---|---|---|
| 1565428 | 4/1970 | Fed. Rep. of Germany |
| 1428346 | 1/1966 | France |
| 2081695 | 10/1971 | France |
| 6502729 | 9/1965 | Netherlands |
| 896422 | 5/1962 | United Kingdom |
| 1022103 | 3/1966 | United Kingdom |
| 1044455 | 9/1966 | United Kingdom |
| 1211024 | 11/1970 | United Kingdom |

OTHER PUBLICATIONS

"Characteristics of a New Serrated Choke," Toniyasu et al., IRE Transactions-Microwave Theory and Techniques, pp. 33-36, Jan. 1956.

*Primary Examiner*—Roy N. Envall, Jr.
*Assistant Examiner*—Philip H. Leung
*Attorney, Agent, or Firm*—Spencer & Frank

[57] ABSTRACT

A microwave oven comprising an enclosure including a wall member defining an opening for providing access to a heating cavity, the wall member having a continuous uninterrupted planar surface portion substantially surrounding the access opening. A door is provided for closing the opening in the wall member, the door having a continuous uninterrupted planar surface portion positioned, when the door is closed, opposite and substantially parallel to the planar surface portion of the wall member. An energy seal comprising walls defining a sealing cavity is formed in either the wall member or the door, the sealing cavity extending in a longitudinal direction to substantially surround the continuous uninterrupted planar surface portion of the member in which it is located. A segmented partition wall is interposed between the walls of the sealing cavity thereby separating it into two longitudinally extending spaces. A path is formed by the opposing planar surface portions of the wall member and the door which extends from the heating cavity to the sealing cavity resulting in substantial reduction, in combination with the sealing cavity, in the amount of microwave energy leaking from the heating cavity when the heating cavity is radiated with microwave energy from a microwave generator.

14 Claims, 29 Drawing Figures

ELECTROMAGNETIC ENERGY SEAL FOR HIGH FREQUENCY HEATING APPARATUS

This is a continuation of application Ser. No. 253,259, filed May 15, 1972, abandoned.

BACKGROUND OF THE INVENTION

This invention relates to a microwave oven and, more particularly, to a wave seal of a microwave oven.

In a microwave oven, in which microwaves are radiated into a heating cavity thereof for heating objects placed therein, it is necessary to prevent the microwave from leaking to the outside of the heating cavity mainly through a gap created between two opposite surfaces, one being a wall portion defining an opening of the heating cavity and the other the wall of a door provided for closing the opening. Hitherto, a so-called choke seal has been employed to prevent such leakage of microwaves, as typically disclosed in U.S. Pat. No. 3,182,164. The choke seal is very effective in preventing the leakage of microwaves so long as the wavelength of the microwaves is not substantially changed from a specific design value. However, it does not satisfactorily prevent the leakage of microwaves if the wavelength varies to some extent from that value due to, for example, variation of the microwave oven. The load variation is a function of the quantity or property of objects being cooked in the heating cavity. The center frequency of the microwaves varies somewhat according to the condition of the load being cooked. Thus, the choke seal alone is not useful as a wave seal for the microwave oven, and it has been the practice to utilize it in combination with a different type of wave seal such as a capacitance seal, metal to metal contact seal or wave absorber, such as a ferrite-rubber. Such structure, however, inevitably introduces complexity in structure, high cost in manufacturing and inconvenience in use of the microwave oven.

SUMMARY OF THE INVENTION

Recently, the safety standards for allowable leakage of microwave have come to be strictly applied to microwave ovens. In order to meet the safety standards, we have studied experimentally how the wave seal of microwave ovens might be improved. From our experimental study, it has been found that the leakage of microwaves is satisfactorily prevented even if the wavelength thereof changes to some extent from the specific value by providing at least one of two opposite walls, one of which is the wall defining the opening of the heating cavity and the other of which is the wall of a door provided for enclosing the opening, with a sealing cavity extending longitudinally around the opening and by separating the sealing cavity longitudinally into two spaces by a metal partition which consists of a plurality of segments spaced from one another by slits transversely distributed across the partition. As a microwave oven provided with such a sealing cavity was operated at various different loads during the experimental study, the wavelength of the microwaves varied with the load variation, but the leakage of the microwaves from the heating cavity was almost completely prevented in spite of such variations in wavelength. The present invention has been developed on the basis of the aforementioned experimental study.

Primarily, the present invention has as an object to provide a microwave oven in which the leakage of microwaves is efficiently prevented, regardless of possible variation of the wavelength thereof, by forming a sealing cavity in at least one of two opposite walls, one of which is the wall defining an opening of the heating cavity and the other of which is the wall of a door provided for enclosing the opening, said sealing cavity extending longitudinally around the opening and being separated into two spaces by a partition which extends longitudinally in the sealing cavity and is divided into a plurality of segments by slits formed transversely across the partition.

Another object of the present invention is to provide a microwave oven comprising a highly efficient wave seal, wherein the sealing effect does not deteriorate even if the door is gapped with some distance from the wall defining the opening of the heating cavity.

Still another object of the present invention is to provide a microwave oven comprising a compact and highly efficient wave seal.

A further object of the present invention is to provide a microwave oven comprising a sealing cavity, as above mentioned, as a wave seal in which the sealing cavity is filled with a dielectric material thereby increasing the effective depth of the sealing cavity and preventing dust from accumulating in the sealing cavity.

A stillfurther object of the present invention is to provide a microwave oven comprising a sealing cavity, as abovementioned, as a wave seal in which the sealing cavity is separated into two spaces by a partition which is divided into a plurality of segments. A still further object of the present invention is to provide a microwave oven comprising a sealing cavity, as mentioned above, as a wave seal in which the sealing cavity is provided with an intermediate metallic wall which is divided into a plurality of segments, the intermediate metallic wall including at least one canted portion so as to increase the effective depth of the partition thereby increasing the sealing effect of the sealing cavity.

A still further object of the present invention is to provide a microwave oven comprising a sealing cavity, as abovementioned, as a wave seal in which the sealing cavity is divided into two spaces which are electromagnetically isolated thereby increasing the sealing effect of the sealing cavity.

BRIEF DESCRIPTION OF THE DRAWINGS

The above and other objects, features and advantages of the present invention will be apparent from the following description of preferred embodiments thereof, in conjunction with the accompanying drawings wherein.

DESCRIPTION OF THE PREFERRED EMBODIMENTS

Figure 1:
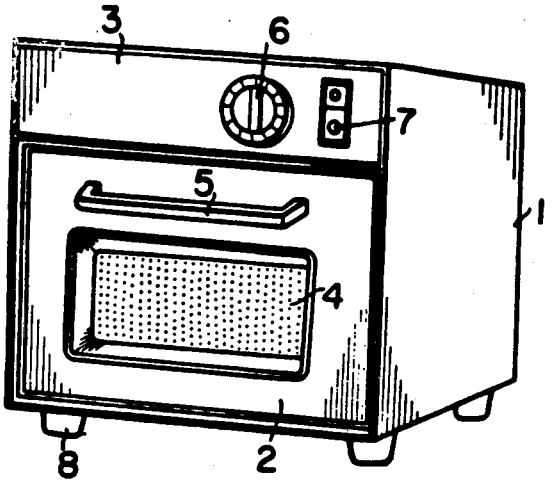
FIG. 1 is a perspective view of a microwave oven according to the present invention.

In a microwave oven shown in FIG. 1, 1 is a housing of the microwave oven, 2 a door pivotally mounted to the housing for enclosing an opening of a heating cavity as mentioned in more detail hereunder, 3 an operating panel mounted on an upper portion of the forward side of the housing 1, 4 a sealing plate fitted into an inspection window formed at the center portion of the door 2 for inspection and punched with a number of perforations for facilitating inspection inside the heating cavity without opening the door, 5 a door handle, 6 a timer knob, 7 a starting switch for operation and 8 is one of the supports for the housing.

Figure 2:
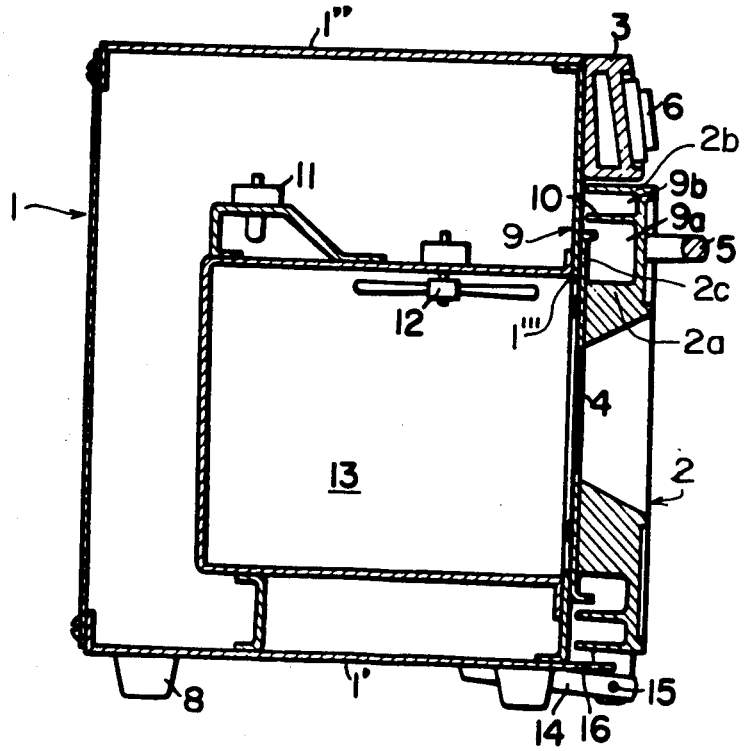
FIG. 2 is a sectional view of the microwave oven in FIG. 1.
Figure 3:
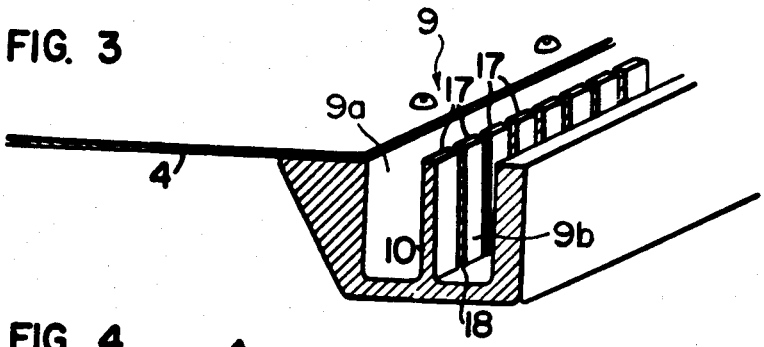
FIG. 3 is a sectional perspective view of a part of the sealing cavity formed into the wall of the door along the edge thereof.

Now referring to FIG. 2 which shows a sectional view of the microwave oven, the housing 1 having a bottom member 1′ and a top member 1″ defines the heating cavity 13 at the center portion thereof, and a forward wall 1‴ of the housing defines an opening of the heating cavity for providing an access thereto. The opening is closable by the door 2 which is pivotally mounted on a pin 15, which in turn is supported by a pair of supporting levers 14 fixed to the housing 1. The heating cavity is adapted to receive microwaves radiated from a microwave generator 11 located at the upper portion of the heating cavity. A rotatable stirrer 12 may be provided for agitating microwave energy radiated into the heating cavity from the microwave generator. In order to prevent the leakage of microwaves, the door 2 is formed with a sealing cavity 9 at a side wall 2*c* thereof opposing to the forward wall portion 1‴ adjacent to the edge of the opening of the heating cavity 13 which extends longitudinally around the opening. The sealing cavity 9 defined by spaced walls 2*a* and 2*b* is separated into two spaces 9*a* and 9*b* by a partition 10 which extends longitudinally in the cavity. As shown in FIG. 3, the partition 10 is divided into a plurality of segments 17 each spaced about 1–2 mm from an adjacent one by a slit 18 formed transversely across the partition. The sealing cavity 9 is inherently different from a conventional choke cavity as mentioned in detail hereinafter. Side walls enclosing the periphery of the door 2 partially oppose metal sashes 16 which may be extensions of the side walls of the housing 1. As abovementioned, the present invention has features in that the wave seal in a microwave oven is accomplished by providing the door 2 or an opposite wall thereto with a sealing cavity 9 which is separated by a partition 10 consisting of a plurality of segments 17 spaced from one another by slits 18.

The sealing effect of the wave seal according to the present invention will now be described on the basis of data obtained from our experimental study. The data were all measured for microwave ovens a follows:

| Microwave oven for domestic use | | |
|---|---|---|
| Magnetron: | Radio Frequency Output 550W 2450MHZ | |
| Heating cavity: | Height | 250 mm |
| | Width | 330 mm |
| | Depth | 250 mm |
| Door size: | Height | 300 mm |
| | Width | 420 mm |

Figure 4:
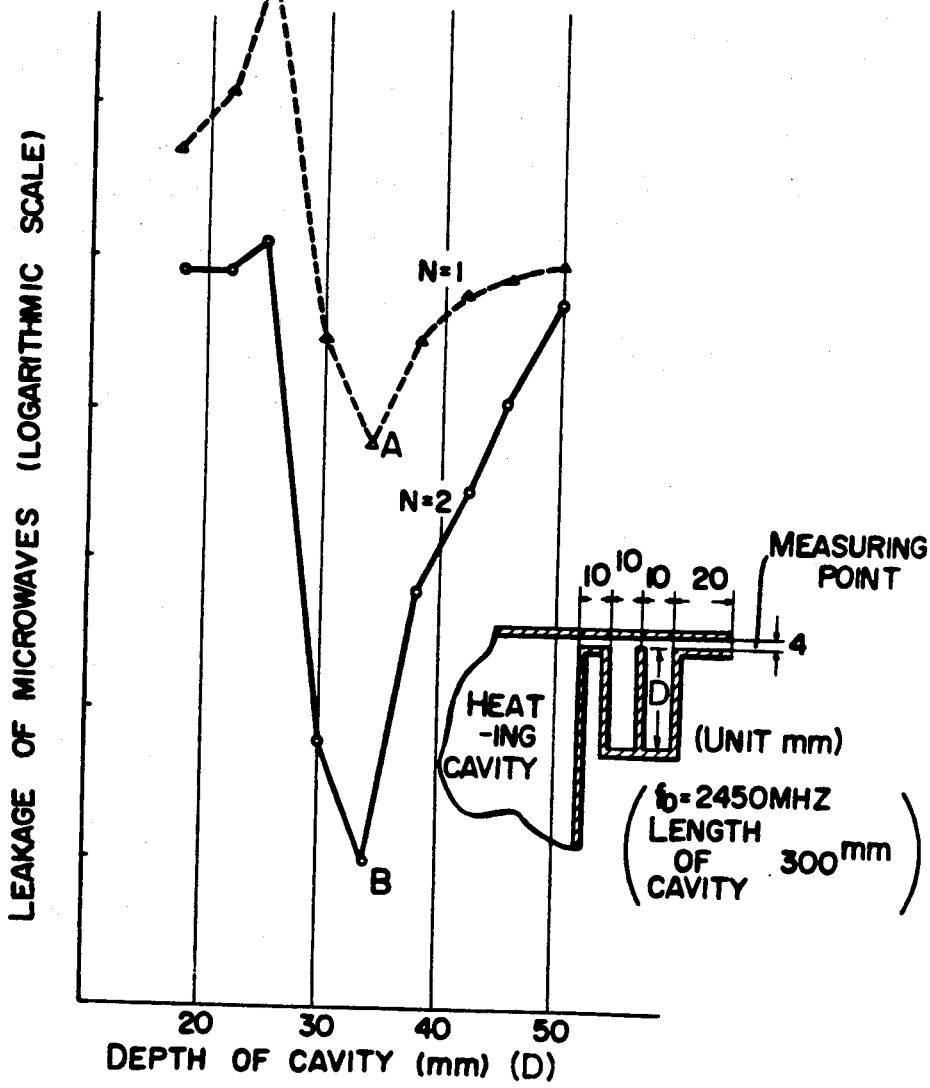
FIG. 4 shows experimental curves showing the amount of microwave leakage relative to the depth of a prior art sealing cavity.

FIG. 4 shows the amount of microwave leakage of a microwave oven having a conventional wave seal consisting of two cavities separated by a partition of a flat metal sheet and having dimensions as schematically indicated on the right-hand of FIG. 4, in which, however, the cavities are formed into the wall defining the opening of the heating cavity. As the depth D of each cavity is changed, the amount of microwave leakage varies along the full line. If the wave seal consists of a single cavity, the amount of microwave leakage increases as shown by the dotted line. In the so-called choke seal, the sealing effect is attained by forming a cavity or cavities having dimensions corresponding to the point A or B in FIG. 4. By increasing the number of cavities, the sealing effect of the wave seal will be improved to some extent. However, the improvement is limited by the space available for the wave seal, because the sealing effect of each cavity greatly decreases if the width thereof is made too narrow by increasing the number of cavities. In practice, the allowable maximum width for the wave seal is about 5 cm in domestic microwave ovens. The present invention has succeeded in improvement of the sealing effect beyond the limitation of the conventional wave seal.

Figure 5:
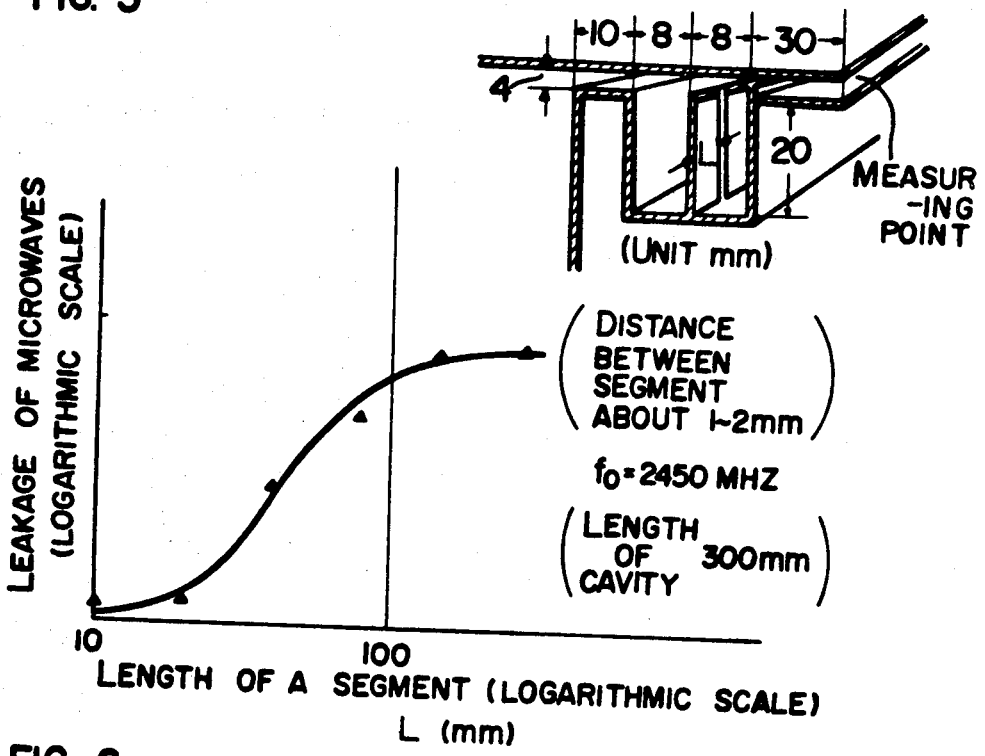
FIG. 5 shows an experimental curve showing the amount of microwave leakage relative to the width of segments of the partition.

FIG. 5 shows the leakage of microwaves from a microwave oven having a sealing cavity according to the present invention. The sealing cavity, whose dimensions are shown on the right-hand side of FIG. 5, in which, however, the heating cavity is formed into the wall defining the opening of the sealing cavity, is separated into two spaces by a metal partition which is divided into a plurality of segments each spaced about 1–2 mm by a slit from an adjacent one. The leakage of microwaves changes along the curve in FIG. 5 with variation of the length L of each segment. The sealing cavity may be formed into the wall of the door substantially without any change of the sealing effect thereof. As will be clear from the curve, when the segment has a length less than about 20 mm, the leakage of microwaves reduces to less than one several tenth of that for the conventional sealing cavity having a plane partition. These values, however, will change somewhat if the wavelength of the microwaves changes. The reason for this effect is not yet solved theoretically and therefore, the optimum dimensions of the sealing cavity must be determined experimentally.

However, as far as we have found from our experimental study, it is true that the leakage of microwaves is always reduced by means of the partition divided into a plurality of segments more efficiently than by a conventional plane partition. The partition according to the present invention may be formed integrally with the door, or made as a separate piece of a metal sheet and fixed by screws to the door. In any event, the wave seal having a structure as abovementioned will meet with the objects of the present invention.

Figure 6:
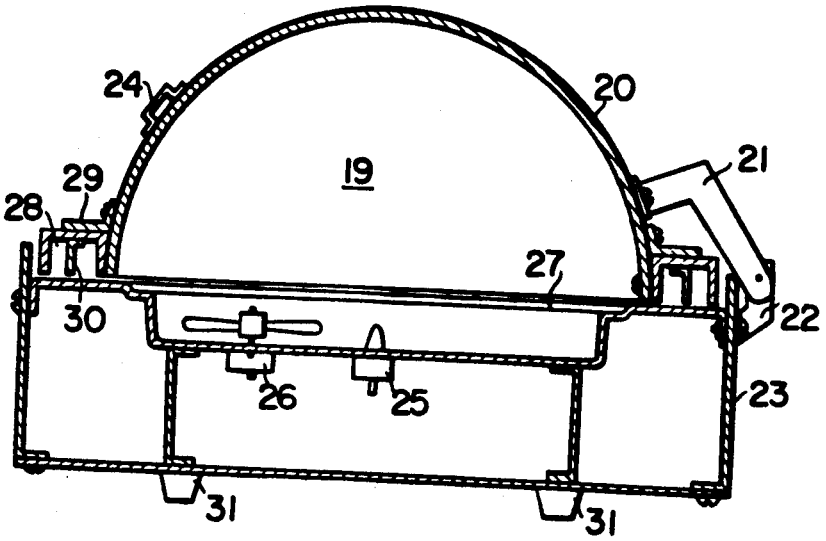
FIG. 6 is a sectional plan view showing a microwave oven having a semi-spherical heating cavity.
Figure 7:
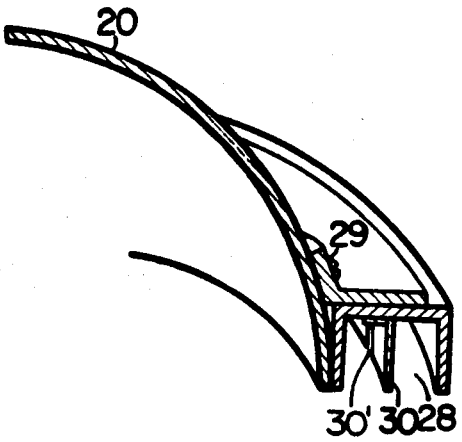
FIG. 7 is a perspective view of a part of the sealing cavity of the microwave oven in FIG. 6.

The wave seal according to the present invention is applicable to a microwave oven having a semi-spherical heating cavity as shown in FIGS. 6 and 7 which are a sectional view of the oven and a perspective view of a part of the wave seal, respectively. In the figures, 19 is the heating cavity, 20 a cover of the heating cavity, 21 a door arm fixed to the cover 20, 22 a support fixed to a housing 23. The door arm 21 is pivotally connected to the support 22. The door 20 is provided with a handle for facilitating opening or closing thereof. 25 indicates a microwave generator, 26 a stirrer, 27 a base plate made of heatproof plastics, 28 a sealing cavity which has a partition 30 divided into a plurality of segments by slits 31 as shown in FIG. 7, 29 a metal bracket for connecting the sealing cavity 28 to the cover 20, and 31 supports for the housing 23. The cover is formed into a semi-spherical shape and, when closed, enclosing therein the semi-spherical heating cavity 19. The cover is pivotally movable to serve as a door for providing an access to the heating cavity.

Hitherto, a wave seal of the metal to metal contact type or the choke seal type has been proposed for the wave seal of the semi-spherical microwave oven. The metal to metal contact wave seal, however, has problems in that the life of the sealing effect is shorter and in that not only forming of the spherical cover of a metal sheet, but also forming of the flat contact surface on the edge thereof is very difficult. For these problems, the metal to metal contact wave seal has not been practically utilized for the semi-spherical microwave oven.

The choke seal has not such problems in manufacturing, but another problem in that the sealing effect thereof is not sufficient. The present invention has solved the problems in not only manufacturing but also in the sealing effect.

Figure 8:
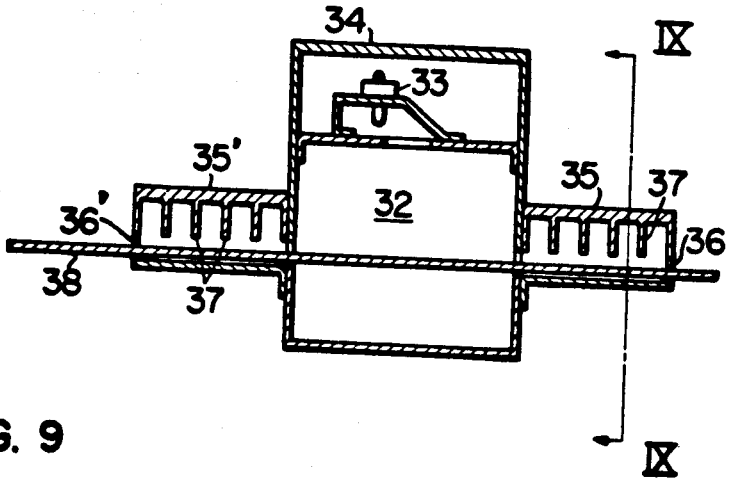
FIG. 8 is a sectional view of a microwave oven furnished to a conveyor system.
Figure 9:
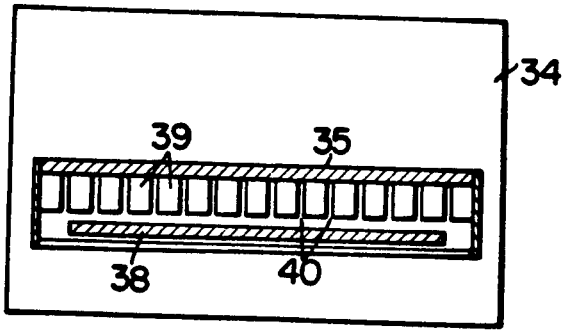
FIG. 9 is a sectional view along IX—IX in FIG. 8.

FIG. 8 shows another embodiment in which a wave seal according to the present invention is applied to a microwave oven combined with a conveyor system. In FIG. 8, 32 indicates a heating cavity, 33 a microwave generator, 34 a cover for sealing microwaves, 38 a conveyor belt for transporting objects into and from the heating cavity 32, 35 and 35' are entry and exit sealing cavities, and 36, 36' are entry and exit ports formed between the conveyor belt and the respective sealing cavities. Each of the sealing cavities is separated into spaces by a plurality of partitions 37. As shown in FIG. 9 which is a sectional view along IX—IX in FIG. 8, each partition is divided into a plurality of segments 39 by slits 40. Hitherto, no wave seal except the choke seal has been applicable to the microwave oven equipped to a conveyor system. The choke seal, however, has a problem in that the sealing thereof is unsatisfactory. This problem also has been readily solved by the present invention.

Figure 10:
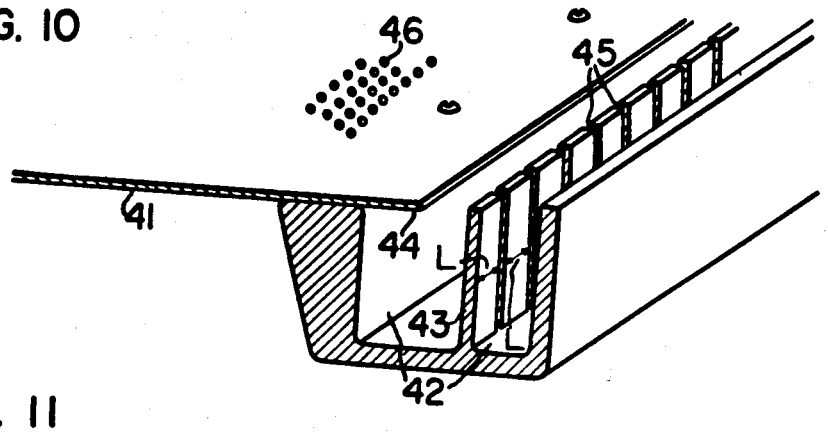
FIG. 10 is a perspective view of a modification of the sealing cavity in FIG. 3.
Figure 11:
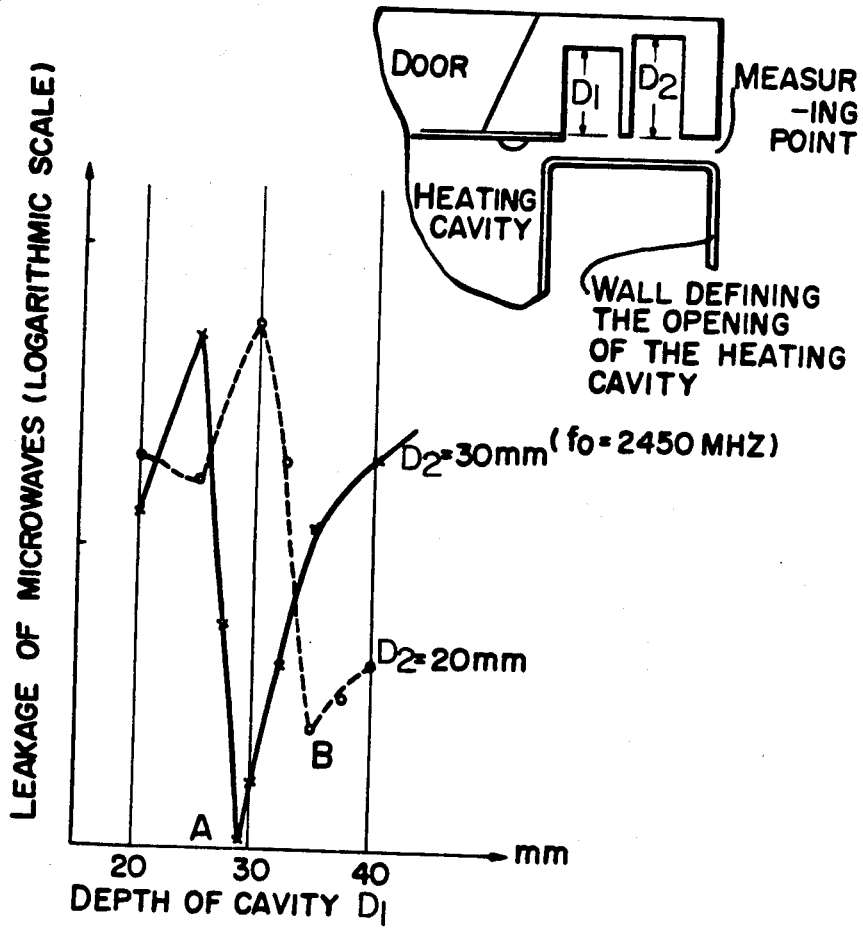
FIG. 11 shows experimental curves showing the amount of microwave leakage relative to the depth of the sealing cavity in FIG. 10.

Now various modifications of the sealing cavity will be explained with reference to FIGS. 10 to 29. In FIG. 10 which shows a part of the door for a heating cavity (not shown), 41 indicates a sealing plate having a number of perforations 46 for facilitating inspection of objects placed into the heating cavity while energizing the heating cavity, and 42 indicates a sealing cavity formed into the door. The sealing cavity 42 is separated into two spaces by a partition which is divided by slits 45 into a plurality of segments 43. This embodiment has features in that the sealing plate 41 extends so as to partially cover an opening of the sealing cavity 42. This structure is effective to reduce the depth of the door. FIG. 11 shows the leakage of microwaves relative to the depth of the sealing cavity having two spaces whose openings are not at all covered as shown on the right-hand thereof. The two spaces of the sealing cavity may have different depths $D_1$ and $D_2$. When the depth $D_2$ is fixed to 20 mm or 30 mm, the leakage of microwaves varies with variation of the depth $D_1$ along the dotted line or the full line, respectively. As seen from the curves, the sealing effect of the cavity is best when the depths $D_1$ and $D_2$ are both about 29 mm. However, if it is necessary to make the door thinner than 29 mm, these dimensions are not applicable. The structure as shown in FIG. 10 provides the same sealing effect as that corresponding to the point B in FIG. 11 where the depths $D_1$ and $D_2$ are 35 mm and 20 mm, respectively. In other words, the structure shown in FIG. 10 has the same sealing effect as a sealing cavity having one space and a depth of 35 mm. By means of a sealing cavity having the above structure, it is possible to provide a door having a thinner depth with a sealing effect which is almost the same as that of a door having a thicker depth, although, strictly speaking, the difference between the points A and B in FIG. 11 is avoidable.

Figure 12:
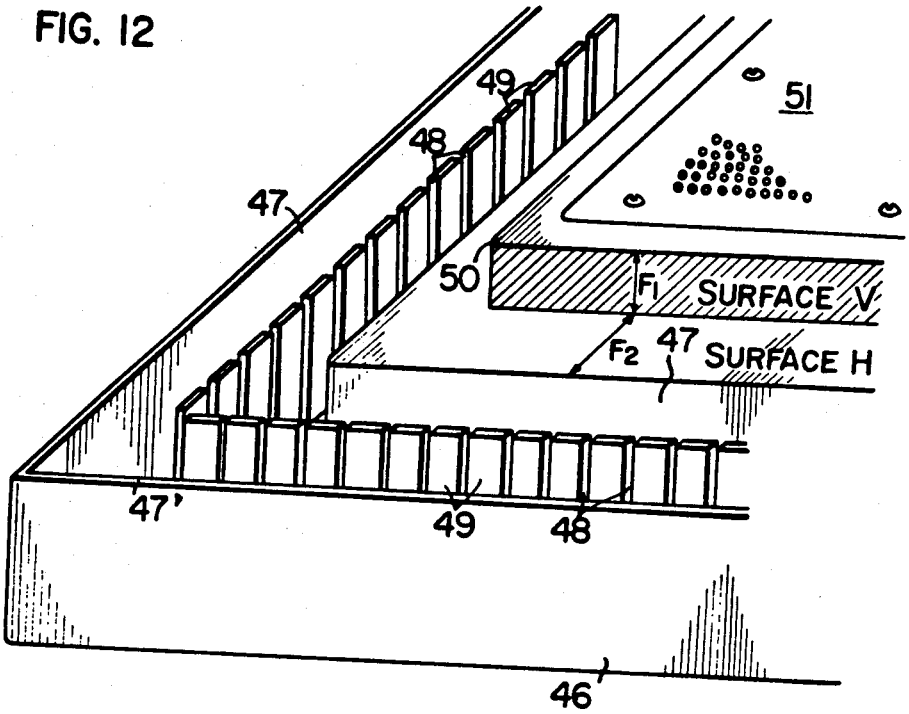
FIG. 12 is a perspective view of another embodiment of the sealing cavity.
Figure 13:
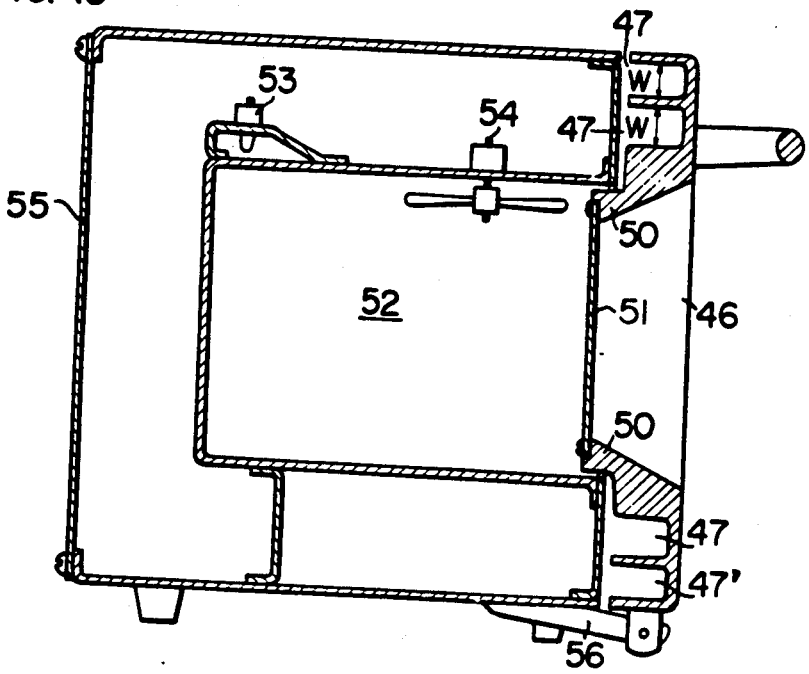
FIG. 13 is a sectional view of a microwave oven having the sealing cavity in FIG. 12.
Figure 14:
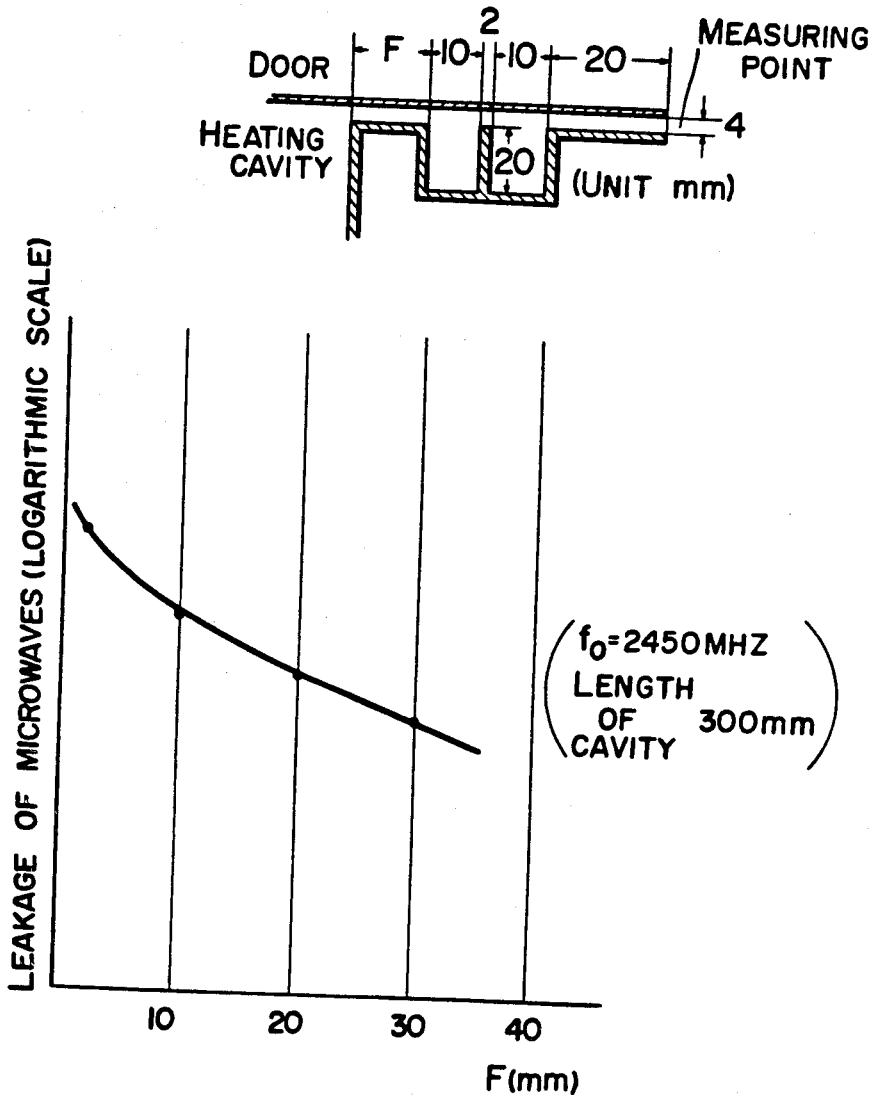
FIG. 14 shows an experimental curve showing the amount of microwave leakage relative to a dimension F which is one of the factors relating to sealing effect of the sealing cavity.

Another embodiment is shown in FIG. 12, in which 46 indicates a door, 47 and 47' a sealing cavity separated into two spaces by a partition which is divided by slits 48 into a plurality of segments 49. The door 46 has a center portion 50 projected by a height $F_1$ from the remaining portion along the edge of the door 46. The remaining portion, in which the sealing cavity is formed, has a surface H aligned with the upper ends of the sealing cavity and the partition. FIG. 13 shows a microwave oven whose heating cavity is closed by a door having the structure as shown in FIG. 12. In FIG. 13, 51 is a sealing plate, 52 a heating cavity, 53 a microwave generator, 54 a stirrer, 55 a housing. This embodiment has features in that the surface H, having a width $F_2$, when the door is closed faces the forward wall defining the opening of the heating cavity, the sum of $F_1$ and $F_2$ being relatively large. The gap created between the wall of the door and the wall of the housing provides a path for the leakage of microwaves and, therefore, the length of the gap affects the leakage of microwaves. It is desirable to make the length of the gap as long as possible. By forming the stepped portion, the length of the gap increases by $F_2$, whereby the sealing effect is increased substantially without increasing the size of the door. FIG. 14 shows the leakage of microwaves from a microwave oven having a sealing cavity as shown schematically on the right-hand thereof relative to the dimension F. The leakage of microwaves varies along the curve in FIG. 14 when the dimension F is changed. As known from the curve, the sealing effect increases by increasing the dimension F. Improvement of the sealing effect is readily attainable by this structure of the wave seal.

Figure 15:
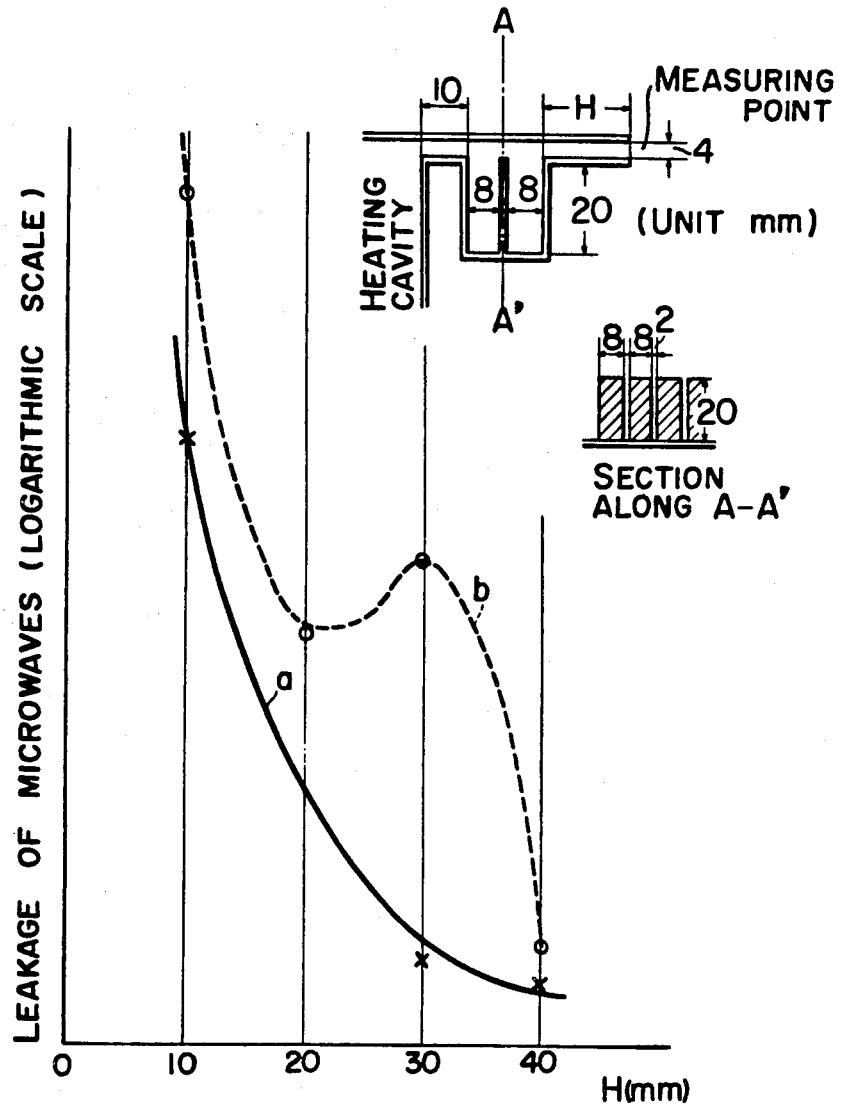
FIG. 15 shows experimental curves showing the amount of microwave leakage relative to another dimension H which is also one of the above factors.

FIG. 15 shows the effect of the sash 16 as described with reference to FIG. 2. In FIG. 2, the sealing cavity is formed into the wall of the door, while, the sealing cavity schematically shown on the right-hand of FIG. 15 is formed into the wall defining the opening of the heating cavity. However, this difference has substantially no influence on the sealing effect of the sealing cavity. The metal sash 16 in FIG. 2 provides an additional narrow gap along the side wall of the door, which has the same sealing effect as that attainable by the gap extending across the width H in FIG. 15. With increasing H, the leakage of microwaves varies along the full line a in FIG. 15 when the sealing cavity has a metallic wall slit into a plurality of segments spaced from one another, while the leakage of microwaves varies along the dotted line b when the sealing cavity is separated by a plain partition. As seen from the dotted line b, in case of the sealing cavity having a conventional structure, the leakage of microwaves does not decrease continuously with increasing H, while, in case of the sealing cavity according to the present invention, the leakage of microwaves decreases continuously. If a door having a thickness of 20–30 mm is employed, and the metal sash 16 is formed to entirely cover the side wall, the narrow gap between the metal sash and the side wall of the door will provide the same sealing effect as that obtainable when the dimension H in FIG. 15 is 20–30 mm. Thus, the metal sash is very effective to improve the sealing effect of the sealing cavity.

Figure 16:
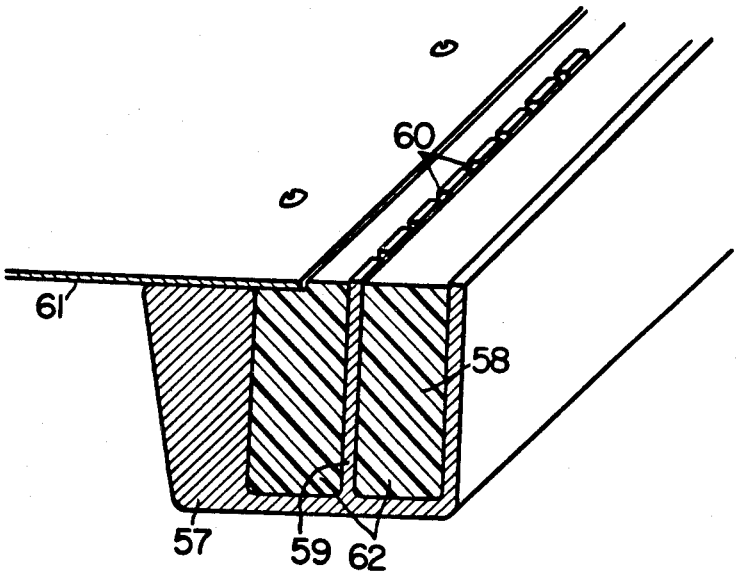
FIG. 16 is a perspective view of the sealing cavity filled with a dielectric material.
Figure 17:
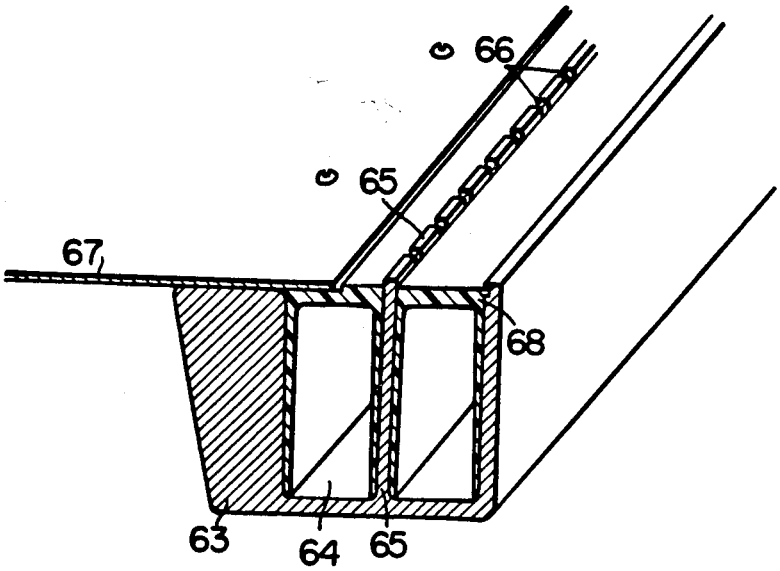
FIG. 17 is a perspective view of the sealing cavity enclosed by a dielectric element.

The sealing cavity of the present invention may be filled with a dielectric material or enclosed by a cover made of a dielectric material, as shown in FIGS. 16 and 17, for increasing the effective size of the cavity or avoiding accumulation of dust in the cavity. In FIG. 16, 57 is a door, 62 a sealing cavity formed into the door and filled with filler 58 of a dielectric material, 59 a partition divided with segments by slits 60, and 61 a sealing plate of the door. In FIG. 17, 63 is a door, 64 a sealing cavity formed into the door 63 and separated into two spaces by a partition 65 divided into segments by slits 66, the spaces each being enclosed by a cover 68 of a dielectric material, and 67 a sealing plate of the door. As seen from FIGS. 16 and 17, in any case, the dielectric material is not filled above the upper end of the partition. This structure is concerned with the relation between the depth of the cavity and the height of the partition, which will be explained with reference to FIG. 18.

Figure 18:
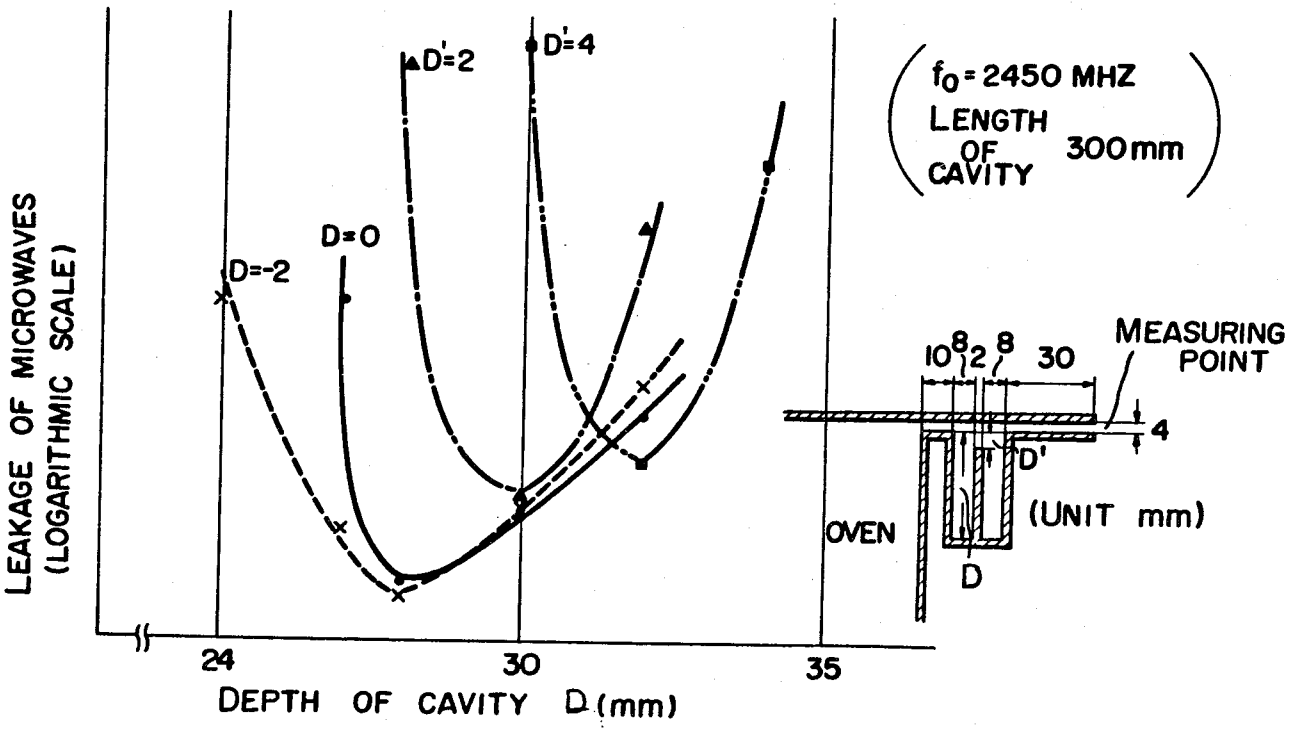
FIG. 18 shows experimental curves showing the amount of microwave leakage relative to the depth of the sealing cavity under different values of a dimension D relating to the partition.

FIG. 18 shows the leakage of microwaves of a microwave oven having a sealing cavity as shown on the right-hand thereof relative to the depth D of the sealing cavity as the height of the partition is changed. D′ indicates the difference between the depth D and the height of the partition and a value of D′ indicates that the depth D is smaller than the height of the partition. When the difference D′ is changed from −2 mm to 0, 2, and 4 mm successively, the leakage of microwaves varies along the curves marked "D′=−2", "D′=0", "D′=2"and "D′=4", respectively. It will be clear that the smaller value of the difference D′, the better the sealing effect. It is well-known that the wavelength of microwaves propagated through a dielectric material having a dielectric constant of $\epsilon$ is reduced to $$\frac{1}{\sqrt{\epsilon}}$$

times that propagated through air whose dielectric constant is 1. Therefore, if the dielectric material is filled above the upper end of the partition, the effective value of the dimension D′ will increase which in turn decrease the sealing effect of the cavity. The above structure is useful for avoiding such disadvantage. However, it is usually unnecessary to utilize such measure for providing a desired sealing effect.

Figure 19:
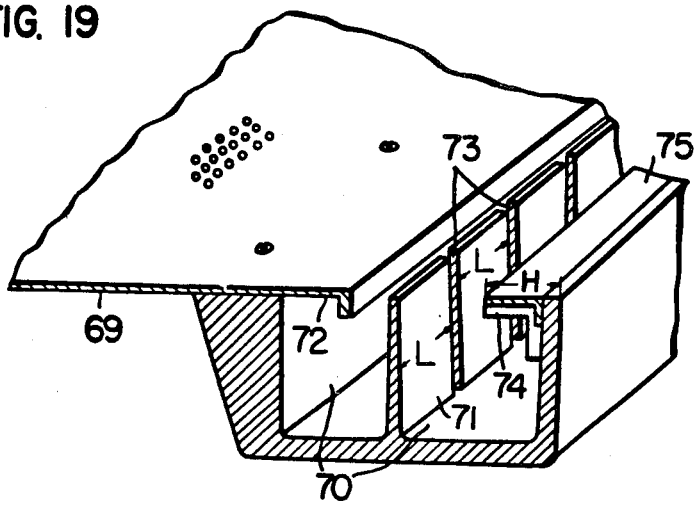
FIGS. 19 to 23 are sectional perspective views showing other embodiments of the sealing cavity.

FIG. 19 shows another embodiment for further improvement of the sealing effect. In FIG. 19, 69 is a sealing plate of the door, 70 a sealing cavity, 71 segments forming a partition for separating the sealing cavity of the sealing plate 69 extended above the sealing cavity, 74 a wave absorber made of ferrite or ferrite rubber, 75 a sealing element made of a metallic material for partially screening the opening of the sealing cavity. This embodiment has features in that the metallic sealing element 75 is fixed to the wall defining the sealing cavity thereby increasing the sealing effect of the sealing cavity, and also providing means for mounting the wave absorber 74.

The sealing element 75 having a width H provides substantially the same effect as that attainable by the extended portion of the sealing plate 41, as shown in FIG. 10, covering partially the opening of the sealing cavity, or by increasing the dimension H in FIG. 15.

The wave absorber 74 may be filled into the sealing cavity for increasing the sealing effect. In any event, it is possible to reduce the depth of the door without decreasing the sealing effect. For example, it is possible to employ a door having a depth of 20 mm with substantially the same sealing effect as that of a door having a depth of 30 mm.

Figure 20:
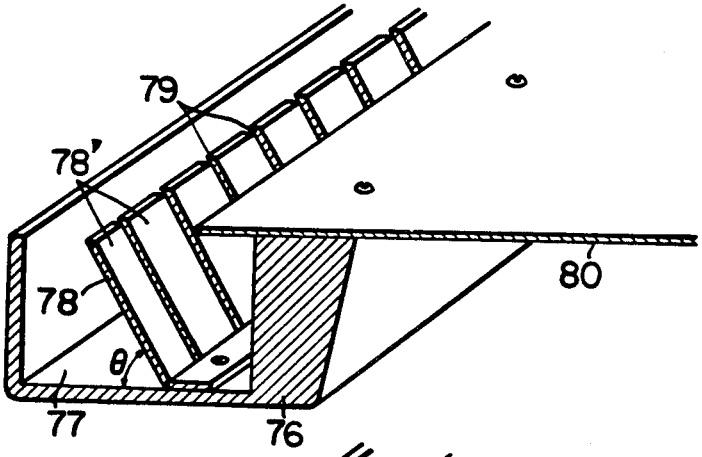

In FIG. 20, which shows another embodiment of the sealing cavity, 76 is a door, 77 a sealing cavity, 78 a canted partition divided into segments 78′ by slits 79, and 80 a sealing plate. This structure has features in that, the partition is canted referring to the wall defining the bottom of the sealing cavity thereby making the height of the partition thereacross larger than the depth of the sealing cavity. For example, assuming that the depth of the sealing cavity is 25 mm, the height of the partition is 30 mm and the partition is fixed to the wall defining the bottom of the sealing cavity with an angle of $\sin^{-1}$ 25/30 therebetween, it has been found that the leakage of microwaves is reduced to several tenth of that attainable by a sealing cavity separated by a partition having a height of 25 mm and fixed perpendicularly to the bottom wall.

Figure 21:
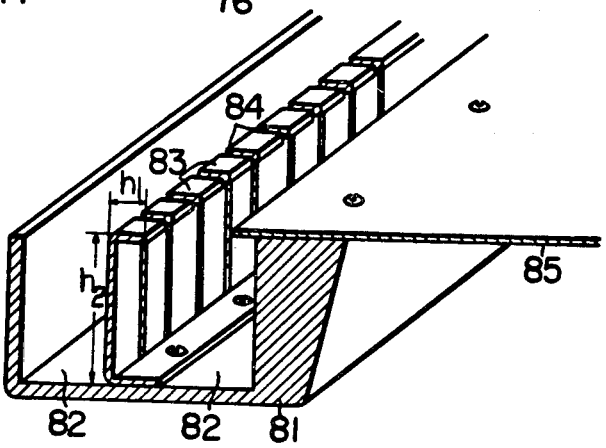
Figure 22:
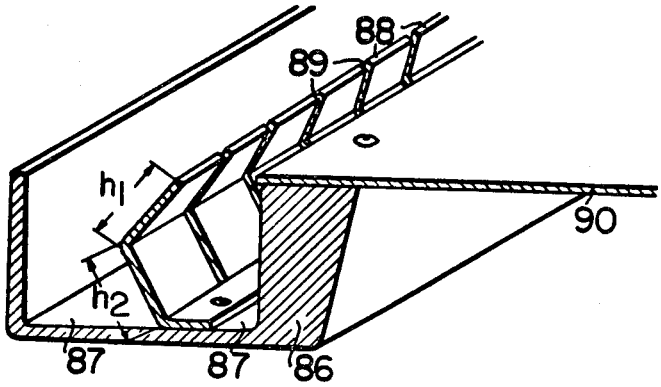
Figure 23:
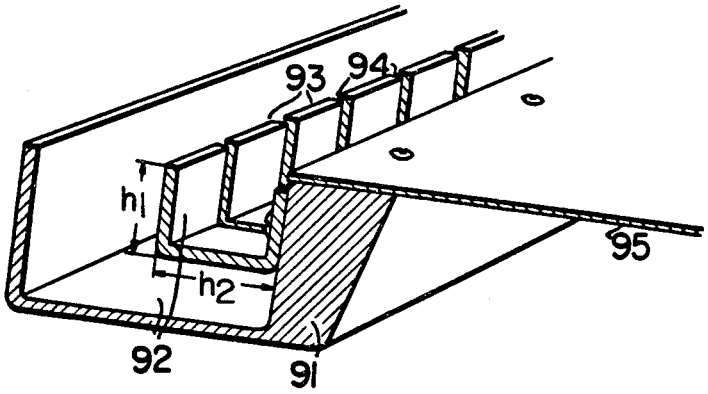

Various modifications of the partition are shown in FIGS. 21 to 23. In FIG. 21, 81 is a door, 82 a sealing cavity which is separated by a partition divided by slits 84 into a plurality of segments 83 each having an end portion bent at a right angle, and 85 a sealing plate. In FIG. 22, 86 is a door, 87 a sealing cavity separated by a partition divided by slits 89 into a plurality of V-shaped segments 88 and 90 a sealing plate. In FIG. 23, 91 is a door, 92 a sealing cavity separated by a partition divided by slits 94 into a plurality of V-shaped segments 93 and 95 a sealing plate. In any modification, the feature thereof resides in that each segment of the partition is bent along a line or lines at an intermediate portion between the upper and lower ends. One-fourth of the wavelength λ of the microwaves is a standard for the total height of each segment, i.e. $h_1+h_2$ as shown in the figures. But practically, it is unnecessary to meet the height $h_1+h_2$ strictly with the value λ/4; however, it is preferable to determine the optimum value experimentally.

The aforementioned sealing cavities are common in that the sealing cavity is separated by a partition divided by slits into a plurality of spaced segments. However, the present invention is not limited to the above structure, but based on the technical concept that microwaves are sealed by a sealing cavity separated by a partition having a plurality of metal segments aligned in a row, and each segment functions to electromagnetically seal microwaves in co-operation with an adjacent segment.

Figure 24:
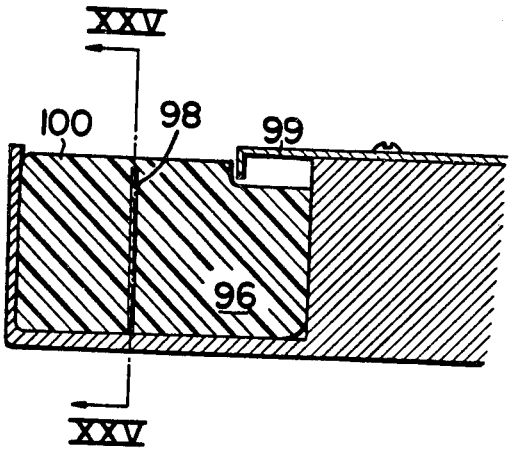
FIG. 24 is a sectional view showing another embodiment of the sealing cavity.
Figure 25:
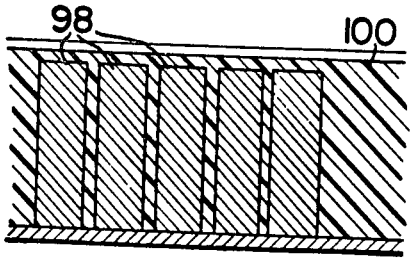
FIG. 25 is a sectional view along XXV—XXV in FIG. 24.

Embodiments based on the above concept are shown in FIGS. 24 to 29. In FIGS. 24 and 25, the sealing cavity 96 is provided with a partition integrally formed with a dielectric filler 100 and consisting of a plurality of metal segments 98, 99 indicating a sealing plate.

Figure 26:
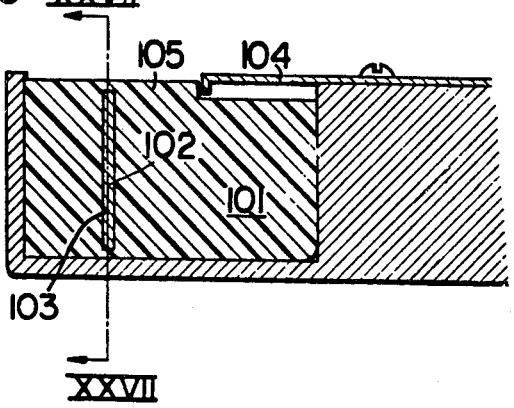
FIG. 26 is a sectional view of further embodiment of the sealing cavity.
Figure 27:
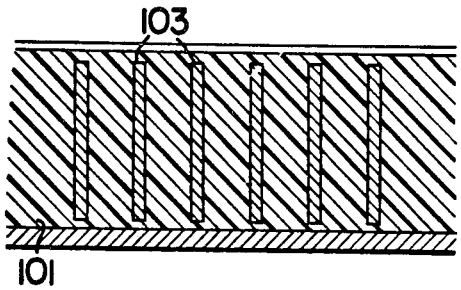
FIG. 27 is a sectional view along XXVII—XXVII in FIG. 26.

In FIGS. 26 and 27, the sealing cavity 101 is provided with a partition 102 formed integrally with a dielectric filler 105 and consisting of a plurality of metal segments 103. 104 indicates a sealing plate of the door.

Figure 28:
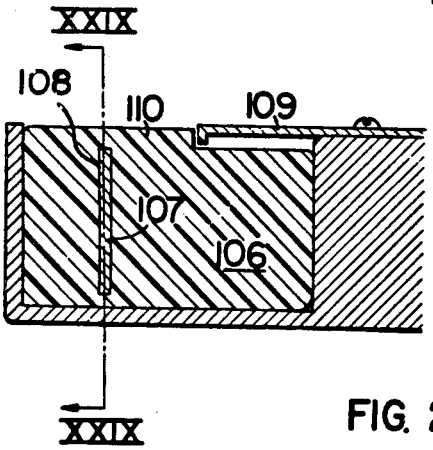
FIG. 28 is a sectional view of still further embodiment of the sealing cavity.
Figure 29:
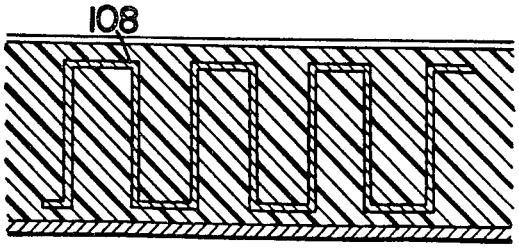
FIG. 29 is a sectional view along XXIX—XXIX in FIG. 28.

In FIGS. 28 and 29, the sealing cavity 106 is provided with a partition 107 formed integrally with a dielectric filler 110 and consisting of a metal wire 108 having a shape like a rectangular wave form. 109 is a sealing plate.

What we claim is:

1. A microwave oven, comprising:

an enclosure having a heating cavity therein, said enclosure including a wall member defining an opening for providing access to said heating cavity, said wall member having a continuous uniterrupted planar surface portion substantially surrounding said access opening;

microwave energy generating means for radiating microwave energy into said heating cavity;

a door for closing the opening in said wall member, said door having a continuous uninterrupted planar surface portion positioned, when the opening in said wall member is covered by said door, opposite and substantially parallel to the planar surface portion of said wall member; and an energy seal comprising at least first and second spaced walls defining a sealing cavity formed in one of said wall member and door, said sealing cavity extending in a longitudinal direction to substantially surround said continuous uninterrupted planar surface portion thereof; and a partition wall interposed between the first and second walls of said sealing cavity and extending in a direction transverse to said longitudinal direction thereby separating said sealing cavity into two longitudinally extending spaces, said partition wall comprising a plurality of segments spaced one from another by slots, a path being formed by the opposing planar surface portions of said wall member and said door which extends from said heating cavity to said sealing cavity resulting in substantial reduction, in combination with said sealing cavity, in the amount of microwave energy leaking from said heating cavity when said microwave energy generating means is actuated.

2. A microwave oven according to claim 1, wherein said plurality of segments are spaced from each other at predetermined regular intervals less than the wave length of microwaves generated by said microwave energy generating means.

3. A microwave oven according to claim 2, wherein said plurality of segments are spaced apart from each other a distance less than the length of adjacent segments.

4. A microwave oven according to claim 1, wherein said partition wall comprises a metal wire having the shape of a rectangular waveform, said partition wall being formed integrally with a dielectric filler in said sealing cavity.

5. A microwave oven according to claim 1, wherein said heating cavity is semispherical in shape and said wall member extends from the circular edge of said cavity to define said access opening.

6. A microwave oven according to claim 1, wherein said door includes a sealing plate for closing said access opening, said sealing plate having an extending portion for at least partially covering said sealing cavity.

7. A microwave oven according to claim 6, wherein said door has a stepped portion which projects into said heating cavity when said door is positioned to close said access opening, said stepped portion being spaced with a gap from said wall member when said stepped portion projects into said heating cavity.

8. A microwave oven according to claim 1, wherein the two longitudinally extending spaces of said sealing cavity are filled with a dielectric material to a level below the upper end of said partition wall.

9. A microwave oven according to claim 1, wherein a wave absorber is mounted on the wall of said sealing cavity most remote from said access opening.

10. A microwave oven according to claim 1, wherein each segment of said partition wall has a length larger than the depth of said sealing cavity.

11. A microwave oven according to claim 1, wherein each segment of said partition wall includes a portion canted toward one of said first and second walls defining said sealing cavity.

12. A microwave oven according to claim 1, wherein each segment of said partition wall is bent at least at one intermediate portion between two opposite ends thereof.

13. The apparatus according to claim 1, wherein said enclosure comprises at least one further wall member extended outwardly from said enclosure adjacent to and spaced from the wall of said energy seal most remote from said access opening.

14. A microwave oven according to claim 1, wherein the depths of the portions of said sealing cavity between said partition wall and said first and second walls are different.

* * * * *